US007460142B2

(12) United States Patent
Masaki et al.

(10) Patent No.: US 7,460,142 B2
(45) Date of Patent: Dec. 2, 2008

(54) IMAGE PROCESSING DEVICE

(75) Inventors: Akihiro Masaki, Osaka (JP); Teruyuki Miyamoto, Osaka (JP); Chisato Hatakeyama, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 146 days.

(21) Appl. No.: 11/285,868

(22) Filed: Nov. 23, 2005

(65) Prior Publication Data

US 2006/0158728 A1 Jul. 20, 2006

(30) Foreign Application Priority Data

Nov. 24, 2004 (JP) ..... 2004-338488

(51) Int. Cl.
*B41J 29/06* (2006.01)

(52) U.S. Cl. ..... 347/138; 347/245; 347/263

(58) Field of Classification Search ..... 347/263, 347/242, 257, 138, 245
See application file for complete search history.

(56) References Cited

U.S. PATENT DOCUMENTS 5,956,072 A * 9/1999 Omura ..... 347/263
6,483,527 B2 * 11/2002 Kaneko et al. ..... 347/138
2007/0279719 A1 * 12/2007 Miyamoto et al. ..... 359/198

FOREIGN PATENT DOCUMENTS

JP 2001-117302 4/2001
JP 2001117302 A * 4/2001
JP 2002-187308 7/2002

OTHER PUBLICATIONS

Computer-generated translation of JP 2001-117302.*

* cited by examiner

*Primary Examiner*—Huan H Tran
(74) *Attorney, Agent, or Firm*—Jordan and Hamburg LLP

(57) ABSTRACT

An image processing apparatus having a structure in which the positioning accuracy of the optical instruments related to image processing are hardly influenced from the condition of the installation surface of the apparatus body. Near the edges of floor plate 60 forming the undersurface of the body of image processing apparatus A, four legs 61, 62, 63*a*, and 63*b* are provided in a protruding manner in three points forming generally a triangle, and optical unit X1 in which the optical instruments are mounted is supported by vertical positioning plate 6*a* or horizontal positioning plate 6*a*, which are a part of the apparatus body's structure, in three points forming a triangle in the same direction as the triangle formed by Legs 61, 62, and 63 in three points when viewed from underneath, and then, these three points are arranged in the position near each of the three points provided with legs 61, 62, and 63 when viewed from underneath.

12 Claims, 6 Drawing Sheets

IMAGE PROCESSING DEVICE

BACKGROUND OF THE INVENTION

1. Field of the Invention

The present invention relates to an image processing apparatus comprising an optical unit in which an optical instrument related to image processing is mounted.

2. Description of the Related Art

Image processing apparatuses, such as copy machines, printers, and facsimiles are housing the optical instruments for image processing in their body chassis.

Also, as have been described in the prior art 1 (Japanese Unexamined Patent Publication No. 2002-187308), with respect to the image processing apparatuses in these days, the optical instruments relevant to image processing, such as the light source (such as, razor beam outputting apparatus) for performing beam light output for writing an electrostatic latent image onto, for example, an image supporter (for a typical example, photoreceptor drum), one or a plurality of deflecting mirrors for guiding beam light to the photoreceptor drum, the fθ lens for performing fθ amendment of beam light, and the polygon mirror for driving beam light to scan in the direction of the axis of the photoreceptor drum, are mounted in the chassis that are made from a single-casting separately from the structures of the bodies, thereby being unitized as the optical unit. The relative positions between the optical instruments are, therefore, determined with high accuracy through the chassis manufactured with high dimensional accuracy by single casting.

On the other hand, the conventional image processing apparatuses are generally provided with protruding legs, that contact with the installation surface, on four points on the undersurface of the apparatus body (generally, four corners of the rectangular undersurface). Moreover, in the prior art 2 (Japanese Unexamined Patent Publication No. 2001-117302), legs (feet) for apparatus stability are provided in three points between the image forming apparatus body and the installation surface in a manner so as to form a rough triangle.

However, as described in Japanese Unexamined Patent Publication No. 2002-187308, even if the optical instruments are unitized, when the supporting member in the side of the apparatus body (the frame of the body side) for supporting the optical unit is warped by such as differences of elevation (distribution of unevenness) on the installation surface of the apparatus, there still remains a problem that the accuracy of positioning of the optical instruments is degraded. Particularly, when legs are provided in four points (four corners) on the undersurface of the apparatus body, the supporting member (frame) in the side of the apparatus body may easily warped by the differences of elevation on the installation surface with which those legs in four points contact.

In addition, as described in Japanese Unexamined Patent Publication No. 2001-117302, even when legs are provided in three points on the undersurface of the apparatus body in a manner so as to form a rough triangle, the supporting member (frame) in the side of the apparatus body may warped because of its own weight, and in if so, there occurs a problem that the accuracy of positioning of the optical instruments may be degraded by the warp of said supporting members, depending on the supporting structure of the optical unit.

Consequently, this invention has been invented considering the foregoing conditions, and the purpose of this invention is to provide the image processing apparatus having the structure that does not easily allow its accuracy of positioning of the optical instruments related to image processing to be influenced from the condition of the installation surface of the apparatus body.

SUMMARY OF THE INVENTION

In order to achieve the foregoing purpose, this invention applies to the image processing apparatuses, such as printers, copy machines, and facsimiles which comprise an optical unit in which an optical instrument related to image processing is mounted in a chassis made from a single casting. Further, near the edges of the undersurface of the present image processing apparatus (such as the undersurface of the floor plate), a plurality of protruding legs, which contact with the installation surface, are provided in three points corresponding to each corner of a rough triangle, with respect to the structure of the present image processing apparatus. And further, the optical unit comprises the structure supported by the above-mentioned structure in three points corresponding to the corners of a triangle in about the same direction (three points forming a triangle in about the same direction) as the rough triangle formed by the above-mentioned legs in three points when viewed from underneath.

Thus, by supporting the whole body of the image processing apparatus with the protruding legs in three points on the undersurface of the apparatus, the apparatus body hardly warps except when a little warped by the balance of its own weight, even if there are some differences of elevation between contacting parts of the legs on the installation surface.

Also, since the optical unit is supported in three points that form a triangle in the same direction as the rough triangle formed by the legs when viewed from underneath, the optical unit is necessarily supported in three points that are as close as possible to the three points of the legs when viewed from underneath. In other words, the three points supporting the optical unit can be closer to the three points of the legs when the size of the optical unit is as large as possible when viewed from underneath (close to the size of the undersurface of the apparatus). Therefore, the optical instruments mounted in the optical unit can be positioned with high accuracy, hardly influenced from the warp of the structure of the apparatus body.

Particularly, the positions overlapping with each of the legs in three points or the three points in the vicinity of these legs when viewed from underneath, are the position hardly influenced from the warp caused by its own weight of the apparatus body, and therefore, when the optical unit has a structure supported in such three points, the optical instruments mounted in such optical unit are hardly influenced from the warp of the apparatus body, thereby being positioned with high accuracy.

More particularly, for example, the legs are provided in each of the close range (two points) of adjacent two corners on the undersurface of generally rectangular shape (nearly rectangular shape) of the apparatus body, and in the close range (one point) of the middle point between remaining two corners, totally in three points. This results in the legs to be arranged so as to form a nearly isosceles triangle or a nearly equilateral triangle when viewed from underneath.

In addition, when a sheet delivery means for delivering a recording sheet for image formation along a sheet delivery path in the nearly vertical direction is comprised, the above-mentioned two points among the three points provided with the legs can be arranged in lower positions in the sheet delivery path in the nearly vertical direction.

In the sheet delivery path in the nearly vertical direction, such as a delivery roller including such as a guide for guiding sheet and a fixing roller, as well as its drive mechanism are arranged in plurality in the longitudinal direction, thereby generally applying a large load intensively on its lower part. Thus, when the two points among the three points, which are provided with the legs, are placed in the lower part of the sheet delivery path in the nearly vertical direction, the image processing apparatus can obtain a stable installation condition, and therefore, the warp of the apparatus body caused by its own weight can be limited as much as possible.

In accordance with this invention, since the image processing apparatus is supported by the protruding legs provided in the structure of the apparatus body in three points forming a rough triangle on its undersurface, the apparatus body is hardly warped except when a little warped by the balance of its own weight, even if there are differences in elevation between contacting parts of the legs on the installation surface.

In addition, since the optical unit is supported by the structure of the apparatus body in three points that form a triangle in the same direction as the rough triangle formed by the legs in three points when viewed from underneath, the optical instruments mounted in the optical unit can be positioned with high accuracy, hardly influenced from the warp of the structure of the apparatus body. Particularly, the positions overlapping with each of the legs in three points, or the three points in the vicinity of these legs when viewed from underneath, are the position hardly influenced from the warp caused by its own weight of the apparatus body, and therefore, when the optical unit is supported in such three points, the optical instruments can be positioned with high accuracy, hardly influenced from the warp of the apparatus body.

Moreover, when the two points among the three points where the legs are provided, are placed in the lower part of the sheet delivery path in the nearly vertical direction where intensively bears a large load, the image processing apparatus can obtain a stable installation condition, and therefore, the warp of the apparatus body caused by its own weight can be limited as much as possible.

BRIEF DESCRITPTION OF THE DRAWINGS

DETAILED DESCRIPTION OF THE PREFERRED EMBODIMENTS

With embodiments of the present invention described hereinafter with reference to the accompanying drawings, it is to be understood that the invention is not limited to those precise embodiments, and that various changes and modifications may be effected therein by one skilled in the art without departing from the scope or spirit of the invention as defined in the appended claims.

Figure 1:
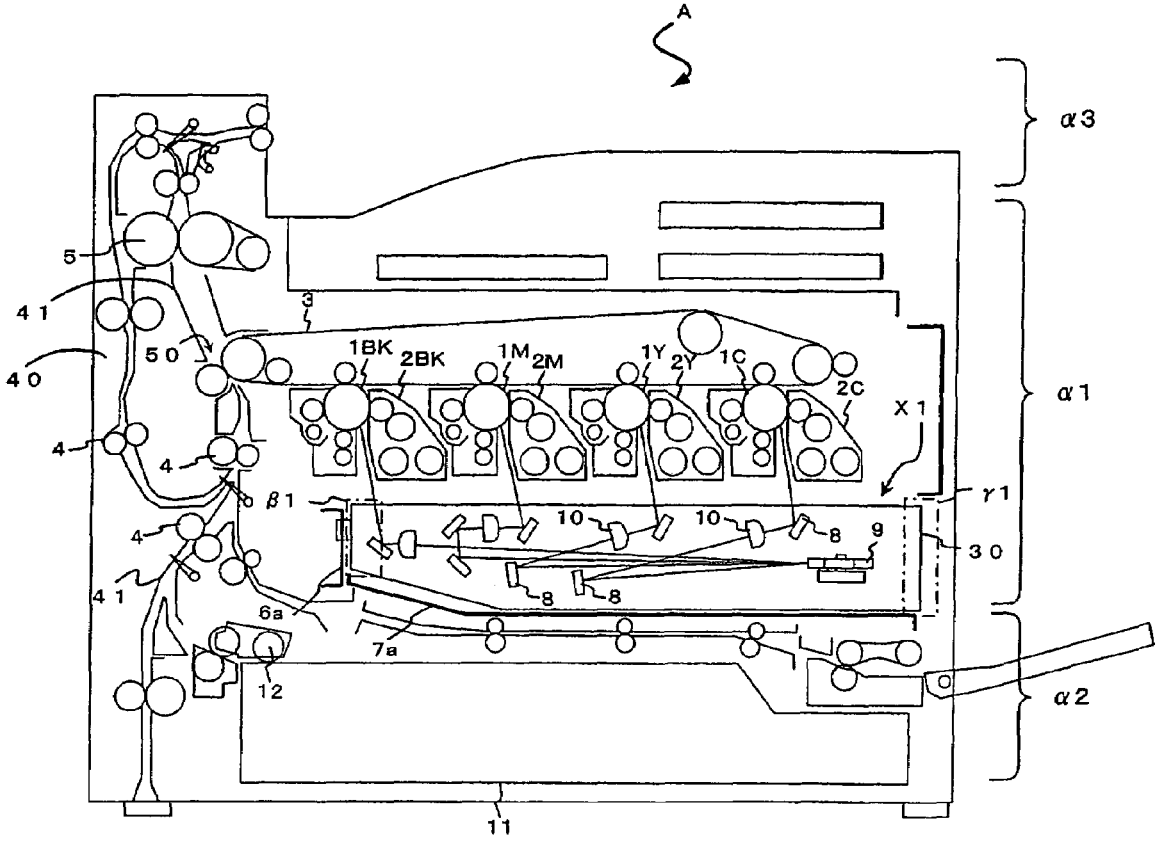
FIG. 1 is a cross-sectional view showing a general structure of an image processing apparatus A according to the embodiment of the present invention.

Firstly, with reference to the cross-sectional view illustrated in FIG. 1, the general structure of entire Image processing apparatus A according to the present invention is described. Image processing apparatus A illustrated in FIG. 1 is a printer (color printer) as one example of the image processing apparatus of electrophotographic system, however, this invention can also be applied to other image processing apparatuses, such as copy machines and facsimiles.

As shown in FIG. 1, Image processing apparatus A comprises Optical unit X1, unitized by a chassis 30 made from a single casting by such as plastic molding (hereinafter referred to as, unit chassis 30), mounting therein the optical instruments (such as the light source, the deflecting mirror, the polygon mirror, the fθ lens) performing output and scanning of beam light for writing an electrostatic latent image onto a plurality of photoreceptor drums: 1BK, 1M, 1Y, and 1C (image supporter), that are tandemly arranged and corresponding to each of a plurality of toner colors (Black, Magenta, Yellow, and Cyan).

Moreover, Image processing apparatus A comprises, such as a printing member α1 for forming a toner image and transferring (printing) it to a recording sheet, a paper feeder α2 for feeding a recording sheet to Printing member α1, and a paper ejector α3 for ejecting a recording sheet printed with a toner image.

In addition, Image processing apparatus A obtains the gradation value information for each of four colors: Black, Magenta, Yellow, and Cyan, by means of image processing controller (not shown), based on printing jobs received from external apparatuses (typically, personal computers) through external input interfaces (not shown), thereby forming images based on the gradation value information.

Printing member α1 has a general structure that comprises: Photoreceptor drums 1BK, 1M, 1Y, and 1C which correspond to each of the above-mentioned four colors (Photoreceptor drum 1BK for Black, Photoreceptor drum 1M for Magenta, Photoreceptor drum 1Y for Yellow, and Photoreceptor drum 1C for Cyan); developing apparatuses 2BK, 2M, 2Y, and 2C which correspond to each of the above-mentioned four colors (Developing apparatus 2BK for Black, Developing apparatus 2M for Magenta, Developing apparatus 2Y for Yellow, and Developing apparatus 2C for Cyan); an intermediate transfer belt 3; a delivery roller 4; a fixing apparatus 5; Optical unit X1; a vertical positioning plate 6*a*; and a horizontal positioning plate 7*a*.

Also, Optical unit X1 is unitized by Unit chassis 30 which is made from a single casting by such as plastic molding, mounting therein the optical instruments, such as: a light source such as a laser diode (not shown) that outputs beam light for writing an electrostatic latent image onto each of Photoreceptor drums 1BK, 1M, 1Y, and 1C; a plurality of deflecting mirrors 8 (reflecting mirror) for reflecting the beam light that is output from the light source and guiding it to each of Photoreceptor drums 1BK, 1M, 1Y, and 1C; a polygon mirror 9 for scanning the beam light that is output from the light source in the direction of the axis of each of Photoreceptor drums 1BK, 1M, 1Y, and 1C (in the depth direction in FIG. 1, in short, in the main scanning direction); a plurality of fθ lenses 10 for performing fθ amendment of the beam light output from the light source. The unit chassis made from a single casting here represents the one also involving the structure wherein optical instruments are mounted in a chassis body of a rough box-shape made from a single casting, which is closed with a rid member for the purpose of light shielding as well as dust prevention of the optical instruments therein.

The above-mentioned image processing controller controls the light source (not shown) corresponding to each of the four colors, so that the beam light corresponding to the gradation value information obtained on the basis of printing jobs from an external apparatus (beam light for writing an electrostatic latent image) is output, along with Polygon mirror 9, so that the beam light is scanned in the direction of axis of each of Photoreceptor drums 1BK, 1M, 1Y, and 1C. Thus, an electrostatic latent image is formed on the surface of Photoreceptor drums 1BK, 1M, 1Y, and 1C respectively.

In addition, developing rollers mounted to Developing apparatuses 2BK, 2M, 2Y, and 2C corresponding to each of Photoreceptor drums 1BK, 1M, 1Y, and 1C, supply toners of respective colors onto the surface of each Photoreceptor drums 1BK, 1M, 1Y, and 1C, then, the electrostatic latent image responds to the electric potential gap (developing bias) between each of Photoreceptor drums 1BK, 1M, 1Y, and 1C and each of the developing rollers, thus becomes a developing image.

Paper feeder α2 has a general structure including such as a paper cassette 11 and a paper feeding roller 12. Paper cassette 11 is preliminarily housing recording sheets. When a printing job is received from an external apparatus, Paper feeding roller 12 is rotationally driven by the control of the image processing controller, thereby delivering a recording sheet for image formation housed in Paper cassette 11 to a sheet delivery path 40 formed in the nearly vertical direction by sheet guides 41.

In Sheet delivery path 40 formed in the nearly vertical direction, a plurality of sheet delivery means such as a plurality of Delivery rollers 4 as well as fixing rollers forming Fixing apparatus 5 are arranged, and deliver the recording sheet along Sheet delivery path 40.

On the other hand, the toner image formed (developed) on each of Photoreceptor drums 1BK, 1M, 1Y, and 1C is transferred to Intermediate transfer belt 3, and by driving Intermediate transfer belt 3, further transferred onto a recording sheet delivered along Sheet delivery path 40 at a transfer member 50. Further, the recording sheet with the transferred toner image is delivered to Fixing apparatus 5 along Sheet delivery path 40, and after fixing the toner image by such as a heating roller for example, discharged to Paper ejector α3.

Figure 2:
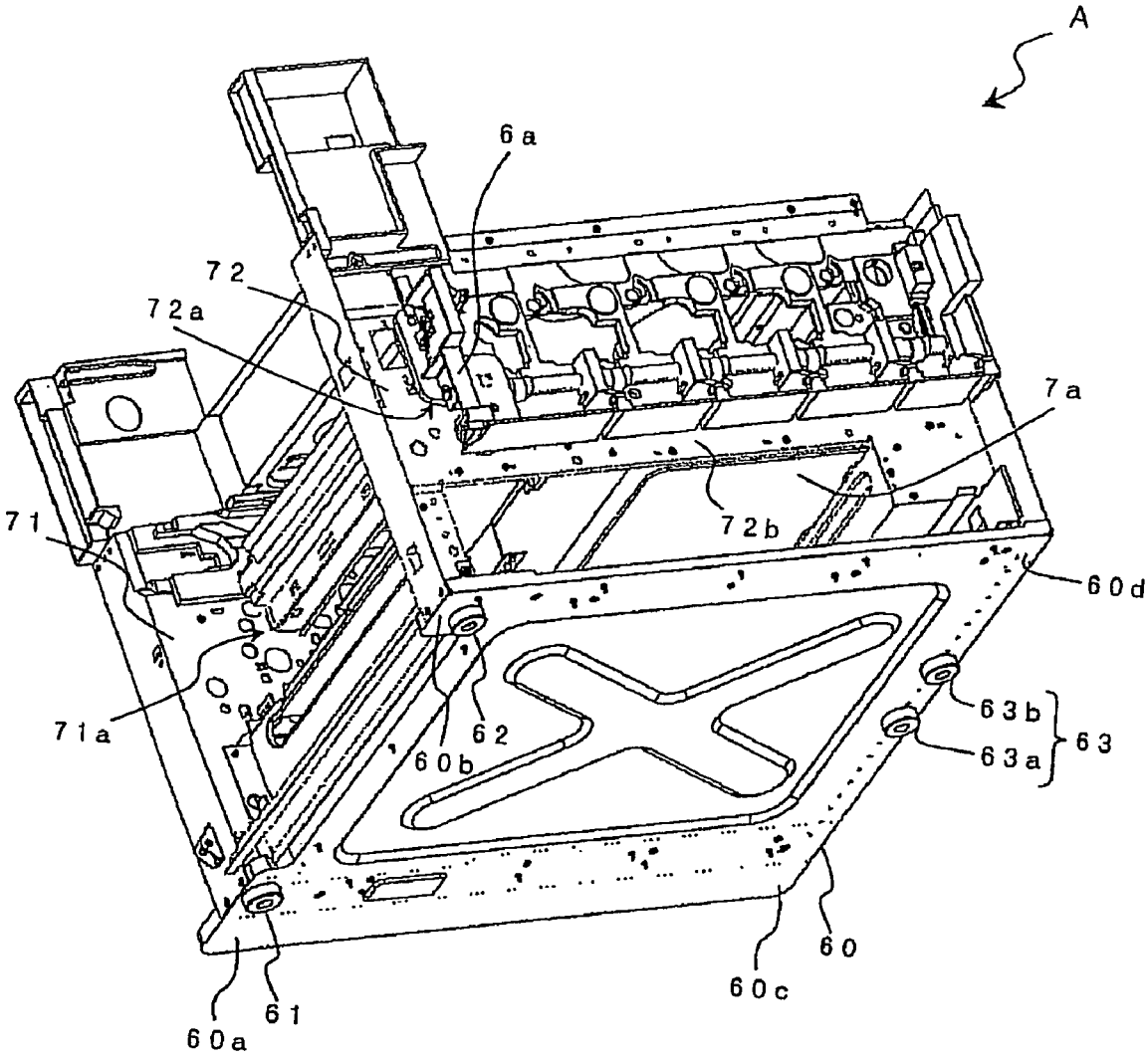
FIG. 2 is a perspective view showing a body structure of Image processing apparatus A, viewed from the undersurface.

FIG. 2 is a perspective view showing a body structure of Image processing apparatus A, viewed from the undersurface side.

As shown in FIG. 2, on a floor plate 60 forming the undersurface (bottom surface) of the body of Image processing apparatus A, near the edges of the undersurface of nearly rectangular shape, four legs 61, 62, 63*a*, and 63*b*, which contact with the installation surface of Image processing apparatus A, are provided in a protruding manner in three points forming generally a triangle (the positions corresponding to the edges of a triangle). Here, Legs 61 and 62 are provided respectively in the positions corresponding to the different edges (top points) of a triangle, while Legs 63*a* and 63*b* (hereinafter generically referred to as Leg 63) are provided close to each other in the position of one point corresponding to one of the edges of a triangle.

Also, in this embodiment, Legs 61 and 62 are respectively provided in a close range of each of adjacent two edges 60*a* and 60*b* on the undersurface of Floor plate 60 (undersurface of the present Image processing apparatus) of generally a quadratic shape (one example of rectangular shapes), while the remaining Leg 63 are provided in a close range of the middle point (center position) between edges 60*c* and 60*d*. Thus, Legs 61, 62, and 63 are provided in a protruding manner so as to form a generally equilateral triangle (in the positions corresponding to the edges of a triangle).

With above-mentioned structure, the apparatus body is hardly warped except when warped by the balance of its own weight, even when there are some differences in elevation between the contacting parts of Legs 61, 62, and 63 on the installation surface.

Here, a plurality of Legs 63 in one point is provided (two in here) in order to ensure the stability of three-point-support, and for example, such as Leg 63 merged into one by such as enlarging its contacting area can also be applied. Additionally, with the structure in which the legs are provided in a protruding manner in three points that generally form a triangle, even when a plurality of the legs are provided in a protruding manner in each points, the same effect can be achieved, and that is the one of the embodiments of this invention.

Also, in Floor plate 60, unevenness is formed by such as press molding in order to ensure sufficient strength so as not to occur a warp caused by its own weight of the apparatus body.

When the undersurface of Floor plate 60 is of generally a rectangular shape (one example of rectangular shapes), it is needless to say that Legs 61, 62, and 63, which contact with the installation surface of Image processing apparatus A, form a generally isosceles triangle when Legs 61, 62, and 63 are arranged in the same manner as the present embodiment.

In addition, Legs 61 and 62 in the two points among the three points, where Legs 61, 62, and 63 are provided, are provided in the lower position of Sheet delivery path 40 formed in the nearly vertical direction (see FIG. 1).

In Sheet delivery path 40 formed in the nearly vertical direction, other than Sheet guides 41 for guiding a sheet, a plurality of means for delivering a recording sheet (sheet delivery means) for image formation along Sheet delivery path 40, such as Fixing apparatus 5, Delivery roller 4 and its drive mechanism (not shown) are arranged in the vertical direction, thereby applying a large load intensively onto the lower part of Sheet delivery path 40. Therefore, similarly to the present embodiment, when the two points among the three points, where Legs 61, 62, and 63 are provided (the points provided with Legs 61 and 62 in a protruding manner), are arranged in lower part of Sheet delivery path 40, the installation condition of Image processing apparatus A becomes stable, thereby preventing as much as possible the warp caused by its own weight of the apparatus body.

Also, FIG. 2 illustrates a condition with such as Sheet delivery path 40 and Delivery roller 4 that are arranged along thereto removed.

Figure 3:
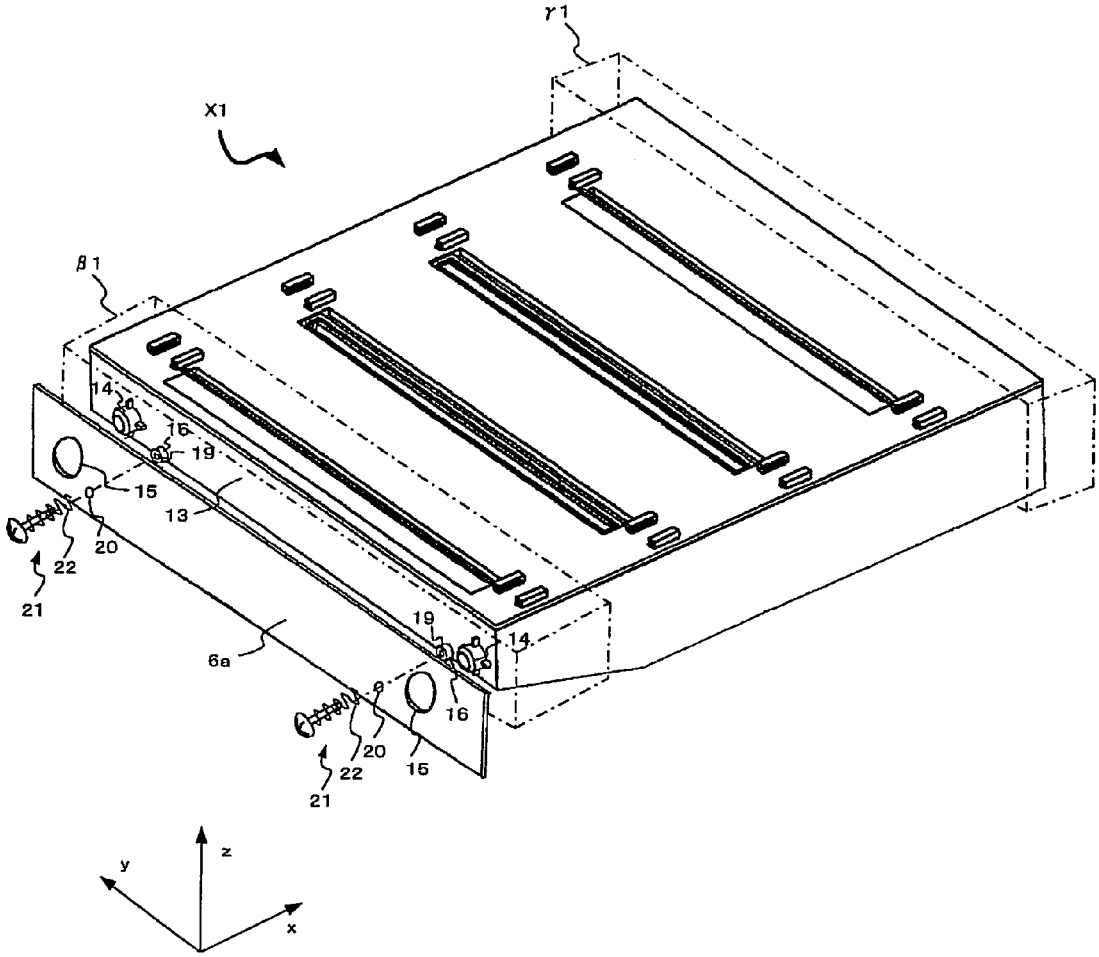
FIG. 3 is a perspective view showing an optical unit X1 comprised in Image processing apparatus A, being supported in two points, viewed from the upper side of the side surface.
Figure 4:
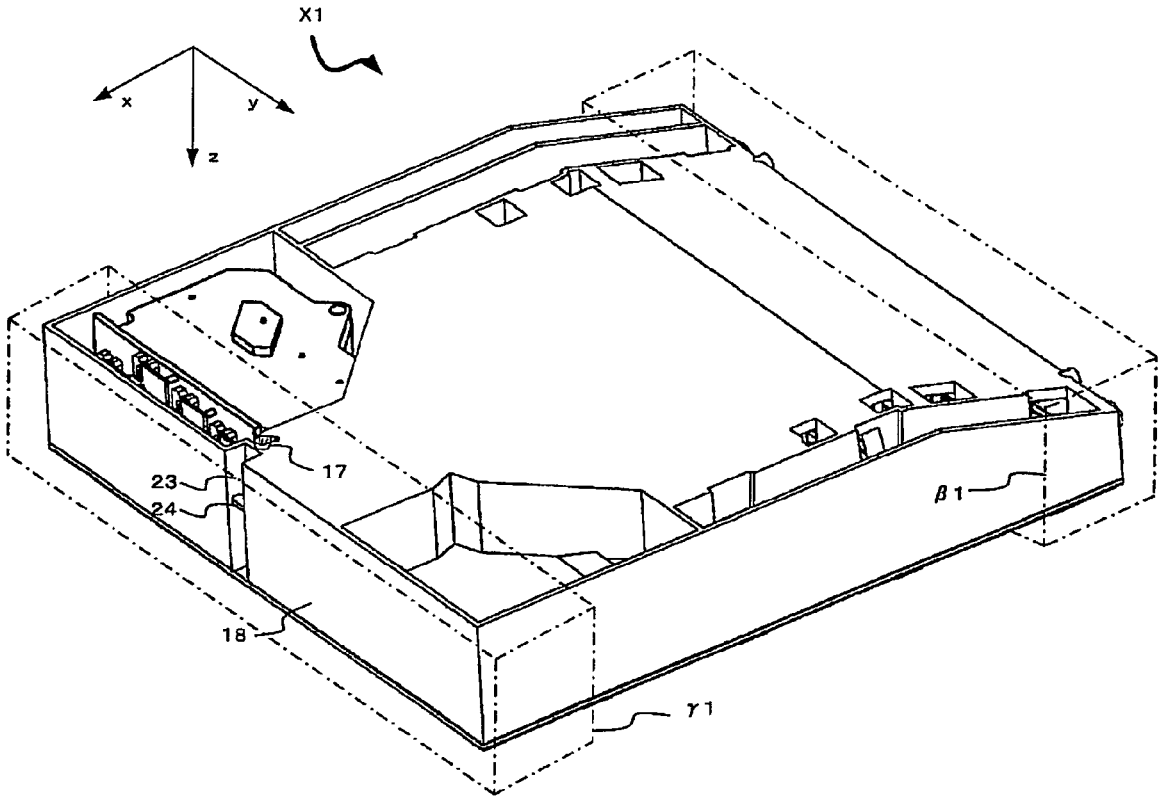
FIG. 4 is a perspective view showing Optical unit X1, viewed from the lower side.
Figure 5:
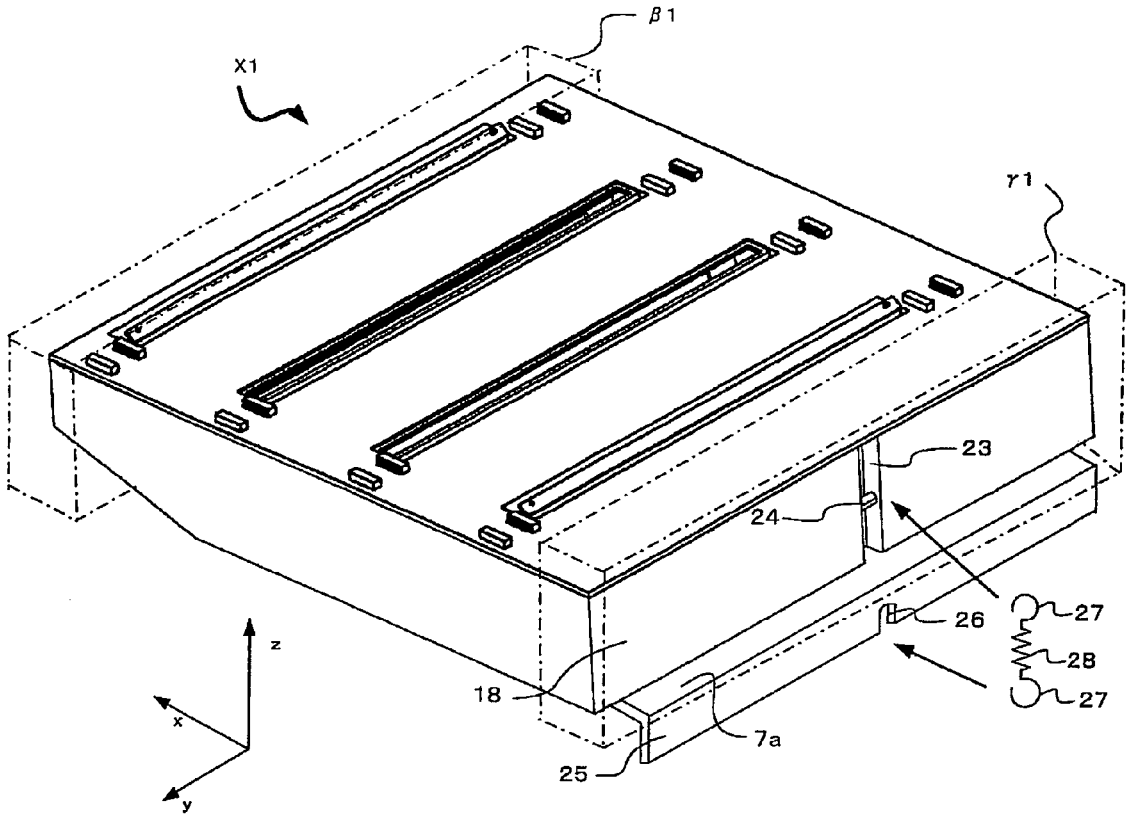
FIG. 5 is a perspective view showing Optical unit X1 viewed from the upper side of the side, which is supported in one point.

As referring now to FIGS. 3, 4, and 5, the supporting structure (positioning structure) of Optical unit X1 is described.

A part of the sidewalls of Optical unit X1 is fitted, in two points, to Vertical positioning plate 6*a* as being a part of the structure (body structure) of the apparatus body's side in Image processing apparatus A, while a part of the undersurface of the same is similarly supported by contacting with Horizontal positioning plate 7*a* as being a part of the structure of the apparatus body.

As shown in the perspective view of FIG. 3, in one side surface of Unit chassis 30 (hereinafter referred to as First side surface 13) forming the exterior of Optical unit X1, two positioning axes 14 are separately provided in a protruding manner in the nearly horizontal direction with a certain interval between them. On the other hand, in Vertical positioning plate 6*a* arranged opposite to First side surface 13, two holes 15 are formed in the positions corresponding to two Positioning axes 14.

Each of two Positioning axes 14 are slidably fitted to two Holes 15, thereby determining the position of Optical unit X1 on the flat surface y-z indicated in FIG. 3.

In addition, in First side surface 13 of Unit chassis 30, two Side surface contacting parts 16 are provided in a protruding manner in the nearly horizontal direction also with a certain interval in the horizontal direction between them. Side surface contacting parts 16 are contacted in two points in the predetermined standard surface side in Vertical positioning plate 6*a* (in FIG. 3, the surface is shielded) by sliding motion (sliding motion in the direction of x-axis illustrated in FIG. 3) under the condition in which each of two Positioning axes 14 is fitted into two Holes 15. Thus, the position of horizontal direction in FIG. 1 (the x-axis direction in the coordinate axis shown in FIG. 3) is determined at the contacting points (two points) of Side surface contacting parts 16, and further, the direction of Optical unit X1 on the flat surface in the horizontal direction (the xy-flat surface in the coordinate axis shown in FIG. 3) is also fixed.

Also, as shown in the perspective view of the undersurface side in FIG. 4, in the undersurface of Optical unit X1, an undersurface side contacting part 17 is provided in a protruding manner. Undersurface side contacting part 17 is contacted in one predetermined point of Horizontal positioning plate 7*a*, thereby positioning Optical unit X1 in the vertical direction (in the z-axis direction shown in FIGS. 3 and 4).

As noted above, with the contacts in totally three points, counting two Side surface contacting parts 16 and one Undersurface side contacting part 17, Optical unit X1 (the chassis of the unit side) is positioned with respect to the structure of Image processing apparatus A.

Additionally, Optical unit X1 is supported in totally three points, counting two Positioning axes 14 and one Undersurface side contacting part 17.

Here, screw holes 19 are provided in two Side surface contacting parts 16. Also, in Vertical positioning plate 6*a*, two through-holes 20 are provided in the position corresponding to Screw holes 19. In short, these Through-holes 20 are formed in the positions overlapping with each of two Screw holes 19, under the condition in which two Side surface contacting parts 16 are contacted with Vertical positioning plate 6*a* by fitting two Positioning axes 14 into two Holes 15.

When attaching Optical unit X1 to Vertical positioning plate 6*a*, Pins 21 stepped and threaded on the edges are inserted from the opposite side of the contacting surface (the standard surface in the above) of Side surface contacting parts 16 into Through-holes 20 provided in Vertical positioning plate 6*a*, thereby screwed into (attached to) Screw holes 19 in Side surface contacting parts 16. Further, springs 22 are inserted between the heads of Pins 21 and Vertical positioning plate 6*a* as an elasticity biasing means, thereby being elastically deformed with giving Pins 21 turns into Screw holes 19. Consequently, the restoring force of Springs 22 acts in the heads of Pins 21, and Optical unit X1 is elastically biased as if being dragged toward Vertical positioning plate 6*a*.

Additionally, as shown in the perspective view in FIG. 4, in the side surface of Optical unit X1 that is supported in one point, in other words, in a second side surface 18 as the side surface opposite to First side surface 13, a groove 23 that extends up and downwardly in the vertical direction is formed in its center, while a bridge member 24 in the horizontal direction is provided therein.

Also, in the edge of Horizontal positioning plate 7*a* placed in the lower side of Optical unit X1, a fold 25 having nearly L shape-cross section is formed, while a cutout 26 of U shape is formed in its center.

Bridge member 24 and Cutout 26 are respectively engaged with hooks 27 formed on both of the edges of a spring 28 as an elastic member. This allows Spring 28 to bear elastic deformation, and, with the restoring force thereof, an edge γ1, in which Second side surface 18 in Optical unit X1 is formed (shortly, the edge opposite to an edge β1 biased in the horizontal direction toward the standard surface), is elastically biased in the vertical direction toward Horizontal positioning plate 7*a* (a part of the structure of the apparatus body), thereby preventing the edges of Optical unit X1 to be misaligned in the horizontal direction.

Figure 6:
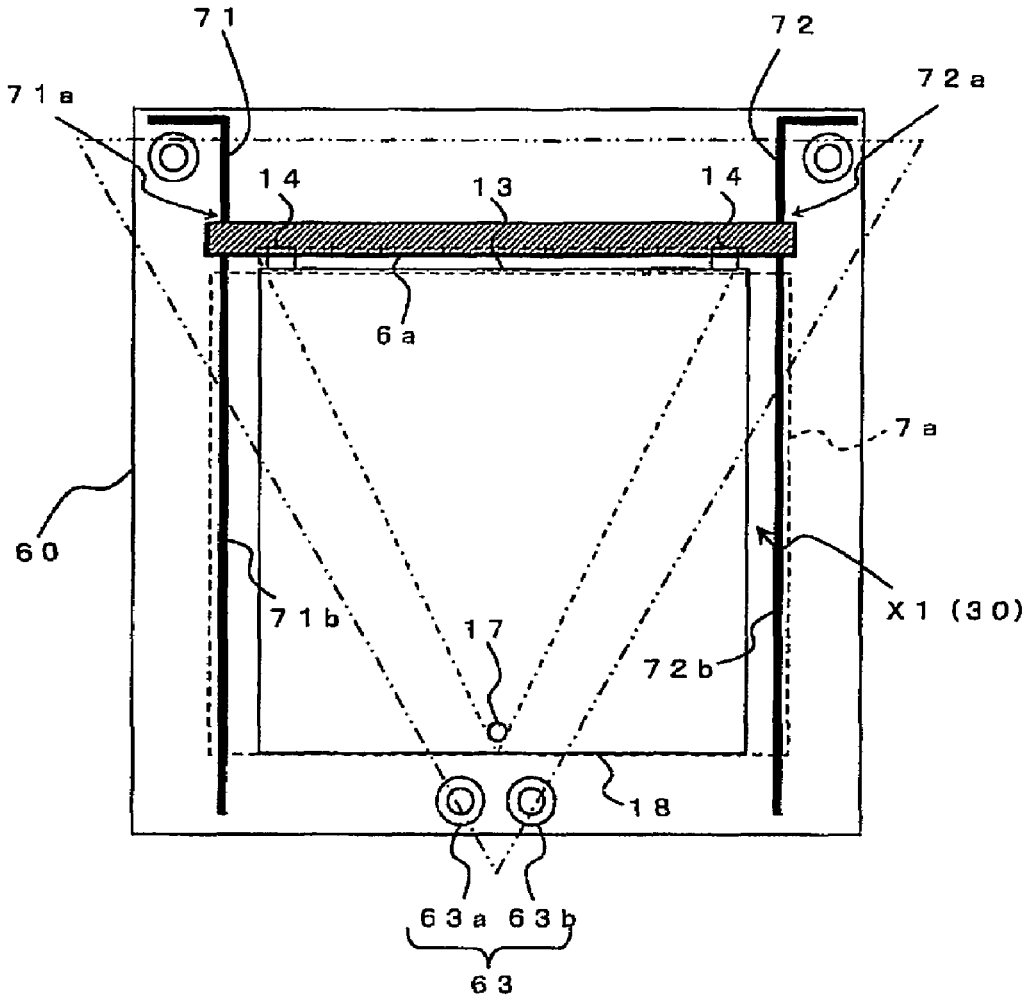
FIG. 6 is a pattern diagram showing a relationship between the positions of legs and the supporting position of Optical unit X1, in accordance with Image processing apparatus A viewed from the lower side.

Secondly, with reference to the perspective view of the undersurface side of the apparatus body's structure illustrated in FIG. 2, as well as the plan view illustrated in FIG. 6, the relationship between the positions of Legs 61, 62, and 63 in the undersurface of Image processing apparatus A and the supporting position of Optical unit X1 is described.

As shown in FIG. 2, in Image processing apparatus A, in each of upper parts of two points among the three points provided with Legs 61, 62, and 63, two vertical frames 71 and 72 as the rigid-body member (here, the metallic member) extending in the nearly vertical direction are provided as a part of the apparatus body's structure. Each of Vertical frames 71 and 72 also extends in the arranging direction of Photoreceptor drums 1BK, 1M, 1Y, and 1C, so as to also form side plates 71*b* and 72*b* (71*b* is shown in FIG. 6 that will be described later) that form a part of the apparatus body's structure. Additionally, Horizontal positioning plate 7*a* (see FIG. 1) as the rigid-body member (here, the metallic member) is connected (fixed) to each of Side plates 71*b* and 72*b* in these Vertical frames 71 and 72 in an astride manner, thereby configuring a part of the apparatus body's structure.

In addition, Vertical positioning plate 6*a* as the rigid-body member, whose longer direction is formed by extending in the nearly horizontal direction, is connected to each of Vertical frames 71 and 72 in an astride manner in two connections 71*a* and 72*a*, thereby configuring a part of the apparatus body's structure.

As described in the above, Optical unit X1 is supported by Vertical positioning plate 6*a* in two points with a certain interval in the horizontal direction between them at the part of two Positioning axes 14 (see FIG. 3).

FIG. 6 is a pattern diagram showing a relationship between positions of Legs 61, 62, and 63 and the supporting position of Optical unit X1, in accordance with Image processing apparatus A viewed from underneath.

As mentioned in the above, Legs 61, 62, and 63 are provided near the edges of the undersurface of Floor plate 60 (the undersurface of the apparatus) in three points so as to form a generally equilateral triangle or isosceles triangle (indicated in a chain double-dashed line in FIG. 6).

Also, as indicated in FIG. 6, Optical unit X1 has a structure supported by Vertical positioning plate 6*a* or Horizontal positioning plate 7*a* that are a part of the apparatus body's structure, in totally three points: the part of two Positioning axes 14 and the part of Undersurface side contacting part 17, which are the three points forming a triangle (the chain line in FIG. 6) in the same direction (the edges of a triangle in the same direction) as the nearly equilateral triangle (the chain double-dashed line in FIG. 6) formed by Legs 61, 62, and 63 in three points viewed from underneath.

Further, these three points: the parts of two Positioning axes 14 and the part of Undersurface side contacting part 17, as the supporting points of Optical unit X1, are arranged in the near positions of each of three points provided with Legs 61, 62, and 63 when viewed from underneath.

With the structure noted above, the optical instruments mounted in Optical unit X1 are positioned with high accuracy, hardly influenced from the warp of the apparatus body.

In the embodiment described above, the present invention is described as referring to a printer as one example of the image processing apparatus, however, this is not intending to limit the scope, and the present invention can be obviously applied to copy machines and facsimiles, as well as to the complex machines having functions of each of these apparatuses.

What is claimed is:

1. An image processing apparatus which comprises an optical unit wherein an optical instrument related to image processing is mounted in a chassis made from a single casting, and wherein legs contacting with an installation surface are provided with respect to a structure of said image processing apparatus in a protruding manner in three points corresponding to each corner of a rough triangle near edges of an undersurface of said image processing apparatus, wherein said optical unit is provided with supported engagement with said structure at three other points corresponding to corners of another triangle in nearly a same direction as said rough triangle formed by said legs when viewed from underneath, and wherein said optical unit includes two positioning axes at two of said three other points, said two positioning axes protruding nearly horizontally from the optical unit, said structure includes a vertical positioning plate having two holes in which said two positioning axes are received to provide a portion of said supported engagement associated with said two of said three other points, said optical unit further including an undersurface side having an undersurface contacting part protruding therefrom at a remaining third one of said three other points,said structure further including a horizontal positioning plate, said underside contacting part contacting said horizontal positioning plate in a nearly vertical direction to provide a remaining portion of said supported engagement associated with said remaining third one of said three other points.

2. An image processing apparatus according to claim 1, wherein:

said optical unit further includes side surface contacting parts carried on a side thereof, and said side surface contacting parts contact two contact points on a predetermined standard surface of said structure arranged in the nearly vertical direction so that the optical unit is positioned in a horizontal direction.

3. An image processing apparatus according to claim 1, wherein said legs are provided in each of close ranges of adjacent two corners and in a close range of a middle point between remaining two corners on an undersurface of nearly rectangular shape of said image processing apparatus.

4. An image processing apparatus according to claim 1, further comprising a sheet delivery device operable to deliver a recording sheet for image formation along a sheet delivery path in the nearly vertical direction, wherein said two points among said legs are lower positions in said sheet delivery path in the nearly vertical direction.

5. An image processing apparatus, comprising:

an optical unit including an optical instrument related to image processing which is mounted in a chassis; and an apparatus body including a housing in which said optical unit is received, legs being carried on an undersurface of said apparatus body to protrude therefrom, said legs being contactable with an installation surface in three contact points, locations of said three contact points each corresponding respectively to a corner of an approximate triangle each disposed in a peripheral region of the undersurface of said housing, said apparatus body including an interior support structure, said optical unit being engaged with said interior support structure at three other points in a manner such that said optical unit is provided with independent support by said interior support structure at said three other points, said three other points positionally corresponding respectively to corners of another triangle arranged approximately in a same direction as the approximate triangle described by said three contact points of said legs when viewed from underneath, said interior support structure including a vertical positioning plate having two holes in a generally vertically oriented portion thereof, said optical unit including two positioning axes protruding in a generally horizontal direction from a side of said optical unit at two of said three other points, said two positioning axes being received in said two holes of said vertical positioning plate to thereby provide a portion of said independent support associated with said two of said three other points.

6. An image processing apparatus according to claim 5, wherein:

the undersurface of said apparatus body has an approximately rectangular shape; and said legs are provided proximate to adjacent two corners and at an approximate middle point between remaining two corners of said approximately rectangular shape.

7. An image processing apparatus according to claim 5, wherein each of said three other points at which said optical unit is independently supported by said interior support structure are positionally proximate to or overlap each of said three contact points when viewed from underneath.

8. An image processing apparatus according to claim 5, wherein said interior support structure further includes a horizontal positioning plate for engaging said optical unit at a remaining third one of said three other points to thereby provide a remaining portion of said independent support associated with said remaining third one of said three other points.

9. An image processing apparatus according to claim 8, wherein said optical unit, includes an undersurface side having an undersurface contacting part protruding therefrom at said remaining third one of said three other points which contacts said horizontal positioning plate at a predetermined point.

10. An image processing apparatus according to claim 9, wherein said undersurface side of said optical unit is elastically biased in a vertical direction towards said horizontal positioning plate.

11. An image processing apparatus according to claim 5, wherein:

said optical unit further includes two side surface connecting parts protruding generally horizontally from said side thereof; and said vertical positioning plate further includes two fastener holes through which fasteners extend, said fasteners being engageable with cooperative structure of said two side surface connecting parts.

12. An image processing apparatus according to claim 5, wherein said side of said optical unit is elastically biased horizontally towards said vertical positioning plate.

* * * * *